US005202563A

United States Patent [19]

Cotter et al.

[11] Patent Number: 5,202,563

[45] Date of Patent: Apr. 13, 1993

[54] TANDEM TIME-OF-FLIGHT MASS SPECTROMETER

[75] Inventors: Robert J. Cotter; Timothy J. Cornish, both of Baltimore, Md.

[73] Assignee: The Johns Hopkins University, Baltimore, Md.

[21] Appl. No.: 700,697

[22] Filed: May 16, 1991

[51] Int. Cl.[5] ..... H01J 49/40

[52] U.S. Cl. ..... 250/287; 250/281; 250/282; 250/286

[58] Field of Search ..... 250/287, 281, 288 R, 250/423 R, 286, 282

[56] References Cited

U.S. PATENT DOCUMENTS

| | | | |
|---|---|---|---|
| 4,694,168 | 9/1987 | Le Beyec et al. | 250/287 |
| 4,731,532 | 3/1988 | Frey et al. | 250/287 |
| 4,851,669 | 7/1989 | Aberth | 250/281 |
| 5,032,722 | 7/1991 | Boesl et al. | 250/287 |
| 5,065,018 | 11/1991 | Bechtold et al. | 250/287 |
| 5,117,107 | 5/1992 | Guilhaus et al. | 250/287 |

FOREIGN PATENT DOCUMENTS

| | | |
|---|---|---|
| 0408288 | 1/1991 | European Pat. Off. . |
| 0448331 | 9/1991 | European Pat. Off. . |
| 0456516 | 11/1991 | European Pat. Off. . |

OTHER PUBLICATIONS

W. C. Wiley, I. H. McLaren, Time-of-Flight Mass Spectrometer with Improved Resolution, The Review of Scientific Instruction, vol. 26, No. 12, Dec. 1955, pp. 1150-1157.

M. L. Muga, Effectiveness of Velocity Compaction Focusing for Improving the Resolving Power . . . , 35th Conf. on Mass Spectrometry and Allied Topics, May 1987, pp. 1126-1127.

F. Knorr, D. Chatfield, Fourier Transform Time of Flight Mass Spectrometry, Dept. of Chemistry, pp. 719-722.

R. Van Breemen, M. Snow, R. Cotter, Time-Resolved Laser Desorption Mass Spectrometry, Inter. Journal of Mass Spectrometry and Ion Physics, 49 (1983) 35-50.

J.-Claude Tabet, R. Cotter, Laser Desorption Time-of-Flight Mass Spectrometry of High Mass Molecules, American Chemical Society, 1984, 56, 1662-1667.

J. Olthoff, I. Lys, P. Demirev, R. Cotter, Modification of Wiley-McLaren TOF Analyzers for Laser Desoprtion, Analytical Instrumentation, 16(1), 93-115 (1987).

J. Olthoff, J. Honovich, R. Cotter, Liquid Secondary Ion Time-of-Flight Mass Spectrometry, American Chemical Society, 1987, 59, 999-1002.

J. Olthoff, R. Cotter, Liquid Secondary Ion Mass Spectrometry, Nuclear Instruments and Methods in Physics Res., B26, 1987, pp. 566-570.

D. Torgerson, R. Skowronski, R. Macfarlane, New Approach to the Mass Spectroscopy of Non-Volatile Compounds, Biochem. and Biophys. Research Comm., vol. 60, No. 2, 1974, pp. 616-621.

B. Chait, F. Field, 252Cf Fission Fragment Ionization Mass Spectrometry of Chlorophyll a, J. Amer. Chem. Soc., 1984, 106, 1931-1938.

(List continued on next page.)

*Primary Examiner*—Constantine Hannaher
*Assistant Examiner*—James Beyer
*Attorney, Agent, or Firm*—Cushman, Darby & Cushman

[57] ABSTRACT

A tandem time-of-flight mass spectrometer comprises a grounded vacuum housing, two reflecting-type mass analyzers coupled via a collision chamber, and flight channels electrically floated with respect to the grounded vacuum housing. The first reflecting-type mass analyzer receives ionized molecules (ions). These ions pass through the flight channel of the first reflecting-type mass analyzer and are fragmented in the collision chamber. The fragmented ions pass through the flight channel of the second reflecting-type mass analyzer. Detectors disposed in the collision chamber and in the second reflecting-type mass analyzer detect the spectrum of the first reflecting-type mass analyzer and the spectra of the tandem time-of-flight mass analyzer, respectively.

33 Claims, 3 Drawing Sheets

OTHER PUBLICATIONS

Y. Beyec, S. Della Negra, C. Deprun, P. Vigny, Y. Ginot, Mass Determination of Molecules of Biological Interest by Fast Heavy Ions Induced . . . , Revue Phys. Appl. 15 (1980) 1631-1637.

A. Viari, Jean-Pierre Ballini, P. Vigny, Sequence Analysis of Unprotected Tri-Deoxyribonucleoside Diphosphates by . . . , Biomed. & Envir. Mass Spec., vol. 14, pp. 83-90 (1987).

P. Hakansson, B. Sundqvist, The Velocity Dependence of Fast Heavy-Ion Induced Desorption of Biomolecules, Radiation Effects, 1982, vol. 61, pp. 179-193.

O. Becker, N. Furstenau, F. Krueger, G. Weib, K. Wien, Ionization of Non-Volatile Organic Compounds by Fast Heavy Ions and Their Separation by . . . , Nuclear Instruments and Methods, 139, (1976), 195-201.

B. Chait, K. Standing, A Time-of-Flight Mass Spectrometer for Measurement of Secondary Ion Mass Spectra, Inter. Journal of Mass Spectrometry and Ion Physics, 40 (1981) 185-193.

K. Tanaka, H. Waki, Y. Ido, S. Akita, Y. Yoshida, T. Yoshida, Protein and Polymer Analyses Up to m/z 100000 by Lazer Ionization Time-of-Flight Mass, Rapid Comm. in Mass Spec., vol. 2, No. 8, 1988, pp. 151-153.

M. Karas, F. Hillenkamp, Laser Desorption Ionization of Proteins with Molecular Masses Exceeding 10000 Daltons, Analytical Chemistry, vol. 60, No. 20, Oct. 15, 1988, pp. 2299-2301.

R. Beavis, B. Chait, Factors Affecting the Ultraviolet Laser Desorption of Proteins, Rapid Comm. in Mass Spectrometry, vol. 3, No. 7, 1989, pp. 233-237.

B. Mamyrin, V. Karataev, D. Shmikk, V. Zagulin, The Mass-Reflection, A New Nonmagnetic Time-of-Flight Mass Spectrometer with High Resolution, Sov. Phys. JETP, vol. 37, No. 1, Jul. 1973, pp. 45-48.

R. Kaufmann, R. Nitsche, A High-Sensitivity Laser Microprobe Mass Analyzer, Applied Physics, vol. 8, (1975), pp. 341-348.

E. Niehuis, T. Heller, H. Feld, A. Benninghoven, High Resolution TOF Secondary Ion Mass Spectrometer, pp. 188-190.

K. Standing, R. Beavis, G. Bolbach, W. Ens, F. Lafortune, D. Main, B. Schueler, X. Tang, J. Westmore, Secondary Ion Time-of-Flight Mass Spectrometers and Data Systems 1,2, Analytical Instrumentation, 16(1), 173-189 (1987).

S. Della-Negra, Y. Beyec, Metastable Ion Studies with a 252Cf Time-of-Flight Mass Spectrometer, pp. 42-45.

J. Grotemeyer, E. Schlag, OMS Letters, Organic Mass Spectrometry, vol. 22, (1987), pp. 758-760.

R. Grix, R. Kutscher, G. Ki, U. Gruner, H. Wollnik, A Time-of-Flight Mass Analyzer with High Resolving Power, Rapid Communications in Mass Spectrometry, vol. 2, No. 5, 1988, pp. 83-85.

W. Poschenrieder, Multiple-Focusing Time of Flight Mass Spectrometers, International Journal of Mass Spectrometry and Ion Physics, 6 (1971) 413-426.

T. Sakurai, Y. Fujita, T. Matsuo, H. Matsuda, A New Time-of-Flight Mass Spectrometer, International Journal of Mass Spectrometry and Ion Processes, 66 (1985) 283-290.

J. Allison, J. Holland, C. Enke, J. Watson, GC/MS by Time-of-Flight Mass Spectrometry: Instrumentation and Data System Developments (Michigan State University), Analytical Instrumentation, 16(1), 207-224 (1987).

G. van der Peyl, K. Isa, J. Haverkamp, P. Kistemaker, Gas Phase Ion/Molecule Reactions in Laser Desorption Mass Spectrometry, Organic Mass Spectrometry, vol. 16, No. 9, 1981.

M. Barber, R. Bordoli, R. Sedgwick, A. Tyler, Fast Atom Bombardment of Solids (F.A.B.): A New Ion Source for Mass Spectrometry, J.C.S. Chem. Comm., 1981, pp. 325-327.

C. Meng, M. Mann, J. Fenn, Of Protons or Proteins, Z. Phys. D—Atoms, Molecules and Clusters 10, 361-368 (1988).

TANDEM TIME-OF-FLIGHT MASS SPECTROMETER

The invention disclosed herein was supported at least in part by funds received from the National Institutes of Health under Grant No. NIH: R01 GM-33967. Accordingly, the Government may have certain rights in this invention.

BACKGROUND OF THE INVENTION

Mass spectrometers are instruments that are used to determine the chemical structures of molecules. In these instruments, molecules become positively or negatively charged in an ionization source and the masses of the resultant ions are determined in vacuum by a mass analyzer that measures their mass/charge (m/z) ratio. Mass analyzers come in a variety of types, including magnetic field (B), combined (double-focusing) electrical (E) and magnetic field (B), quadrupole (Q), ion cyclotron resonance (ICR), quadrupole ion storage trap, and time-of-flight (TOF) mass analyzers. Double focusing instruments include Nier-Johnson and Mattauch-Herzog configurations in both forward (EB) and reversed geometry (BE). In addition, two or more mass analyzers may be combined in a single instrument to form a tandem mass spectrometer (MS/MS, MS/MS/MS, etc.). The most common MS/MS instruments are four sector instruments (EBEB or BEEB), triple quadrupoles (QQQ), and hybrid instruments (EBQQ or BEQQ).

The mass/charge ratio measured for a molecular ion is used to determine the molecular weight of a compound. In addition, molecular ions may dissociate at specific chemical bonds to form fragment ions. Mass/charge ratios of these fragment ions are used to elucidate the chemical structure of the molecule. Tandem mass spectrometers have a particular advantage for structural analysis in that the first mass analyzer (MS1) can be used to measure and select molecular ions from a mixture of molecules, while the second mass analyzer (MS2) can be used to record the structural fragments. In tandem instruments, a means is provided to induce fragmentation in the region between the two mass analyzers. The most common method employs a collision chamber filled with an inert gas, and is known as collision induced dissociation CID. Such collisions can be carried out at high (5-10 keV) or low (10-100 eV) kinetic energies, or may involve specific chemical (ion-molecule) reactions. Fragmentation may also be induced using laser beams (photodissociation), electron beams (electron induced dissociation), or through collisions with surfaces (surface induced dissociation). While the four sector, triple quadrupole and hybrid instruments are commercially available, tandem mass spectrometers utilizing time-of-flight analysis for either one or both of the mass analyzers are not commercially available.

In a time-of-flight mass spectrometer, molecular and fragment ions formed in the source are accelerated to a kinetic energy:

$$eV=mv^2/2$$

determined by the potential difference (V) across the source/accelerating region. These ions enter a field-free drift region of length L with velocities (v) that are inversely proportional to the square root of their mass/charge ratios (m/e):

$$v=(2\ eV/m)^{\frac{1}{2}}$$

The time required for a particular ion to traverse the drift region is directly proportional to the square root of the mass/charge ratio:

$$t=L(m/2\ eV)^{\frac{1}{2}}$$

Conversely, mass/charge ratios of ions can be determined from their flight times according to the equation:

$$m/e=at^2+b$$

where a and b are experimental constants determined from the flight times of two ions of known mass/charge.

Generally, time-of-flight mass spectrometers have very limited mass resolution. This arises because there may be uncertainties in the time that the ions were formed (time distriuton), in their location in the accelerating field at the time they were formed (spatial distriution), and in their initial kinetic energy distributions prior to acceleration (energy distriuton).

The first commercially successful time-of-flight mass spectrometer was based on an instrument described by Wiley and McLaren in 1955 (Wiley , W. C.; McLaren, I. H., *Rev. Sci. Instrumen.* 26 1150 (1955)). That instrument utilized electron impact (E1) ionization (which is limited to volatile samples) and a method for spatial and energy focusing known as: time-lag focusing. In brief, molecules are first ionized by a pulsed (1-5 microsecond) electron beam. Spatial focusing was accomplished using multiple-stage acceleration of the ions. In the first stage, a low voltage (−150 V) drawout pulse is applied to the source region that compensates for ions formed at different locations, while the second (and other) stages complete the acceleration of the ions to their final kinetic energy (−3 keV). A short time-delay (1-7 microseconds) between the ionization and drawout pulses compensates for different initial kinetic energies of the ions, and is designed to improve mass resolution. Because this method required a very fast (40 ns) rise time pulse in the source region, it was convenient to place the ion source at ground potential, while the drift region floats at −3 kV. The instrument was commercialized by Bendix Corporation as the model MA-2, and later by CVC Products (Rochester, N.Y.) as the model CVC-2000 mass spectrometer. The instrument has a practical mass range of 400 daltons and a mass resolution of 1/300, and is still commercially available.

There have been a number of variations on this instrument. Muga (TOFTEC, Gainsville) has described a velocity compaction technique for improving the mass resolution (Muga velocity compaction). Chatfield et al. (Chatfield FT-TOF) described a method for frequency modulation of gates placed at either end of the flight tube, and fourier transformation to the time domain to obtain mass spectra. This method was designed to improve the duty cycle.

Cotter et al. (VanBreemen, R. B.: Snow, M.: Cotter, R. J., *Int. J. Mass Spectrom. Ion. Phys.* 49 (1983) 35.; Tabet, J. C.; Cotter, R. J., Anal. Chem. 56 (1984) 1662; Olthoff, J. K.; Lys, I: Demirev, P.: Cotter, R. J., Anal. Instrumen. 16 (1987) 93) modified a CVC 2000 time-of-flight mass spectrometer for infrared laser desorption of involatile biomolecules, using a Tachisto (Needham, Mass.) model 215G pulsed carbon dioxide laser. This group also constructed a pulsed liquid secondary time-of-flight mass spectrometer (liquid SIMS-TOF) utilizing a pulsed (1-5 microsecond) beam of 5 keV cesium ions, a liquid sample matrix, a symmetric push/pull arrangement for pulsed ion extraction (Olthoff, J. K.; Honovich, J. P.; Cotter, *Anal. Chem.* 59 (1987) 999-1002.; Olthoff, J. K. ; Cotter, R. J., *Nucl. Instrum. Meth Phys. Res.* B-26 (1987) 566-570). In both of these instruments, the time delay range between ion formation and extraction was extended to 5-50 microseconds, and was used to permit metastable fragmentation of large molecules prior to extraction from the source. This in turn reveals more structural information in the mass spectra.

The plasma desorption technique introduced by Macfarlane and Torgerson in 1974 (Marfarlane, R. D.; Skowronski, R. P.; Torgerson, D. F., *Biochem. Biophys. Res. Commun.* 60 (1974) 616.) formed ions on a planar surface placed at a voltage of 20 kV. Since there are no spatial uncertainties, ions are accelerated promptly to their final kinetic energies toward a parallel, grounded extraction grid, and then travel through a grounded drift region. High voltages are used, since mass resolution is proportional to $U_o/eV$, where the initial kinetic energy, $U_{03}$ is of the order of a few electron volts. Plasma desorption mass spectrometers have been constructed at Rockefeller (Chait, B. T.; Field, F. H., *J. Amer. Chem. Soc.* 106 (1984) 193), Orsay (LeBeyec, Y.; Della Negra, S.; Deprun, C.; Vigny, P.; Ginot, Y. M., *Rev. Phys. Appl* 15 (1980) 1631), Paris (Viari, A.; Ballini, J. P.; Vigny, P.; Shire, D.; Dousset, P., *Biomed. Environ. Mass Spectrom.* 14 (1987) 83), Upsalla (Hakansson, P.; Sundqvist. B., *Radiat. Eff.* 61 (1982) 179) and Darmstadt (Becker, O.; Furstenau, N.; Krueger, F. R.; Weiss, G.; Wein, K., Nucl. Instrum. Methods 139 (1976) 195). A plasma desorption time-of-flight mass spectrometer has been commercialized by BIO-ION Nordic (Upsalla, Sweden). Plasma desorption utilizes primary ion particles with kinetic energies in the MeV range to induce desorption/ionization. A similar instrument was constructed at Manitobe (Chain, B. T.; Standing, K. G., *Int. J. Mass Spectrom. Ion Phys.* 40 (1981) 185) using primary ions in the keV range, but has not been commercialized.

Matrix-assisted laser desorption, introduced by Tanaka et al. (Tanaka, K.; Waki, H.; Ido, Y.; Akita, S.; Yoshida, Y.; Yoshica, T., *Rapid Commun. Mass Spectrom.* 2 (1988) 151) and by Karas and Hellenkamp (Karas, M.; Hillenkamp, F., *Anal Chem.* 60 (1988) 2299) utilizes time-of-flight mass spectrometry to measure the molecular weights of proteins in excess of 100,000 daltons. An instrument constructed at Rockefeller (Beavis, R. C.; Chait, B. T., *Rapid Commun. Mass Spectrom.* 3 (1989) 233) has been commercialized by VESTEC (Houston, Tex.), and employs prompt two-stage extraction of ions to an energy of 30 keV.

Time-of-flight instruments with a constant extraction field have also been utilized with multi-photon ionization, using short pulse lasers.

The instruments described thus far are linear time-of-flights, that is: there is no additional focusing after the ions are accelerated and allowed to enter the drift region. Two approaches to additional energy focusing have been utilized: those that reflect the ions back through the drift region, and those which pass the ion beam through an electrostatic energy filter.

The reflectron (or ion mirror) was first described by Mamyrin (Mamyrim, B. A.; Karatajev, V. J.; Shmikk, D. V.; Zagulin, V. A., *Sov Phys.*, JETP 37 (1973) 45). At the end of the drift region, ions enter a retarding field from which they are reflected back through the drift region at a slight angle. Improved mass resolution results from the fact that ions with larger kinetic energies must penetrate the reflecting field more deeply before being turned around. These faster ions then catch up with the slower ions at the detector and are focused. Reflectrons were used on the laser microprobe instrument introduced by Hillenkamp et al. (Hillenkamp, F.; Kaufmann, R.; Nitsche, R.; Unsold, E., Appl. Phys. 8 (1975) 341) and commercialized by Leybold Hereaus as the LAMMA (LAser Microprobe Mass Analyzer). A similar instrument was also commercialized by Cambridge Instruments as the IA (Laser Ionization Mass Analyzer). Benninghoven (Benninghoven reflectron) has described a SIS (secondary ion mass spectrometer) instrument that also utilizes a reflectron, and is currently being commercialized by Leybold Hereaus. A reflecting SIS instrument has also been constructed by Standing (Standing, K. G.; Beavis, R.; Bollbach, G.; Ens, W.; Lafortune, F.; Main. D.; Schueler, B.; Tang, X.; Westmore, J. B., *Anal. Instrumen.* 16 (1987) 173).

LeBeyec (Della-Negra, S.; Leybeyec, Y., in *Ion Formation from Organic Solis IFOS III,* ed by A. Benninghoven, pp 42-45, Springer-Verlag, Berlin (1986)) described a coaxial reflectron time-of-flight that reflects ions along the same path in the drift tube as the incoming ions, and records their arrival times on a channel-plate detector with a centered hole that allows passage of the initial (unreflected) beam. This geometry was also utilized by Tanaka et al. (Tanaka, K.; Waki, H.; Ido, Y.; Akita, S.; Yoshida, Y.; Yoshida, T., *Rapid Commun. Mass Spectrom.* 2 (1988) 151) for matrix assisted laser desorption. Schlag et al. (Grotemeyer, J.; Schlag, E. W., Org. Mass Spectrom. 22 (1987) 758) have used a reflectron on a two-laser instrument. The first laser is used to ablate solid samples, while the second laser forms ions by multiphoton ionization. This instrument is currently available from Bruker. Wollnik et al. ( Grix., R.; Kutscher, R.; Li, G.; Gruner, U.; Wollnik, H., Rapid Commun. Mass Spectrom. 2 (1988) 83) have described the use of reflectrons in combination with pulsed ion extraction, and achieved mass resolutions as high as 1/20,000 for small ions produced by electron impact ionization.

An alternative to reflectrons is the passage of ions through an electrostatic energy filter, similar to that used in double-focusing sector instruments. This approach was first described by Poschenroeder (Poschenroeder, W., *Int. J. Mass Spectrom. Ion Phys* 6 (1971) 413). Sakurai et al. (Sakuri, T.; Fujita, Y.; Matsuo, T.; Matsuda, H.; Katakuse, I., Int. J. Mass Spectrom. Ion Processes 66 (1985) 283) have developed a time-of-flight instrument employing four electrostatic energy analyzers (ESA) in the time-of-flight path. At Michigan State, an instrument known as the ETOF was described that utilizes a standard ESA in the TOF analyzer (Michigan ETOF).

Lebeyec et al. (Della-Negra, S.; Lebeyec, Y., in *Ion Formation from Organic Solis IFOS III,* ed. by A. Benninghoven, pp 42-45, Springer-Verlag, Berlin (1986)) have described a technique known as correlated reflex spectra, which can provide information on the fragment ion arising from a selected molecular ion. In this technique, the neutral species arising from fragmentation in the flight tube are recorded by a detector behind the reflectron at the same flight time as their parent masses. Reflected ions are registered only when a neutral species is recorded within a preselected time window. Thus, the resultant spectra provide fragment ion (structural) information for a particular molecular ion. This technique has also been utilized by Standing (Standing, K. G.; Beavis, R.; Bollbach, G.; Ens, W.; Lafortune, F.; Main. D.; Schueler, B.; Tang, X.; Westmore, J. B., *Anal. Instrumen.* 16 (1987) 173).

Although time-of-flight mass spectrometers do not scan the mass range, but record ions of all masses following each ionization event, this mode of operation has some analogy with the linked scans obtained on double-focusing sector instruments. In both instruments, MS/MS information is obtained at the expense of high resolution. In addition correlated reflex spectra can be obtained only on instruments which record single ions on each time-of-flight cycle, and are therefore not compatible with methods (such as laser desorption) which produce high ion currents following each laser pulse. Thus, a true tandem time-of-flight configuration with high resolution would consist of two reflecting mass analyzers, separated by a collision chamber.

New ionization techniques, such as plasma desorption (MacFarlane, R. D.; Skowronski, R. P.; Torgerson, D. F.; *Biocem. Bios. Res. Commun.* 60 (1974) 616), laser desorption (VanBreemen, R. B.; Snow, M.; Cotter, R. J., Int. J. Mass Spectrom. Ion Phys. 49 (1983) 35; Van der Peyl, G.J.Q.; Isa, K.; Haverkamp, J.; Kistemaker, P. G.; Org. Mass Spectrom. 16 (1981) 416), fast atom bombardment (Barber, M.; Bordoli, R. S.; Sedwick, R. D.; Tyler, A. N., *J. Chem. Soc., Chem Commun.* (1981) 325-326) and electrospray (Meng, C. K.; Mann, M. Fenn, J. B., *Z. Pys.* D10 (1988) 361), have made it possible to examine the chemical structures of proteins and peptides, glycopeptides, glycolipids and other biological compound without chemical derivatization. The molecular weights of intact proteins can be determined using matrix-assisted laser desorption on a time-of-flight mass spectrometer or electrospray ionization. For more detailed structural analysis, proteins are generally cleaved chemically using CNBr or enzymatically using trypsin or other proteases. The resultant fragments, depending upon size, can be mapped using matrix-assisted laser desorption, plasma desorption or fast atom bombardment. In this case, the mixture of peptide fragments (digest) is examined directly resulting in a mass spectrum with a collection of molecular ions corresponding to the masses of each of the peptides. Finally, the amino acid sequences of the individual peptides which make up the whole protein can be determined by fractionation of the digest, followed by mass spectral analysis of each peptide to observe fragment ions that correspond to its sequence.

It is the sequencing of peptides for which tandem mass spectrometry has its major advantages. Generally, most of the new ionization techniques are successful in producing intact molecular ions, but not in producing fragmentation. In the tandem instrument the first mass analyzer passes molecular ions corresponding to the peptide of interest. These ions are fragmented in a collision chamber, and their products extracted and focused into the second mass analyzer which records a fragment ion (or sequence) spectrum.

SUMMARY OF THE INVENTION

The invention is a specific design for a tandem time-of-flight mass spectrometer incorporating two reflecting-type mass analyzers coupled via a collision chamber. A novel feature of this instrument is the use of specially-designed flight channels that can be electrically floated with respect to the grounded vacuum housing. This design permits either pulsed extraction or constant field extraction of ions from the ionization source, and either low or high energy collisions in the collision chamber. In addition, the instrument incorporates einsel focusing, square cross-sectional reflectrons, and a relatively high (6°) reflectron angle to achieve small physical size.

Other objects, features and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

DETAILED DESCRIPTION OF THE PRESENTLY PREFERRED EXEMPLARY EMBODIMENTS

Figure 1:
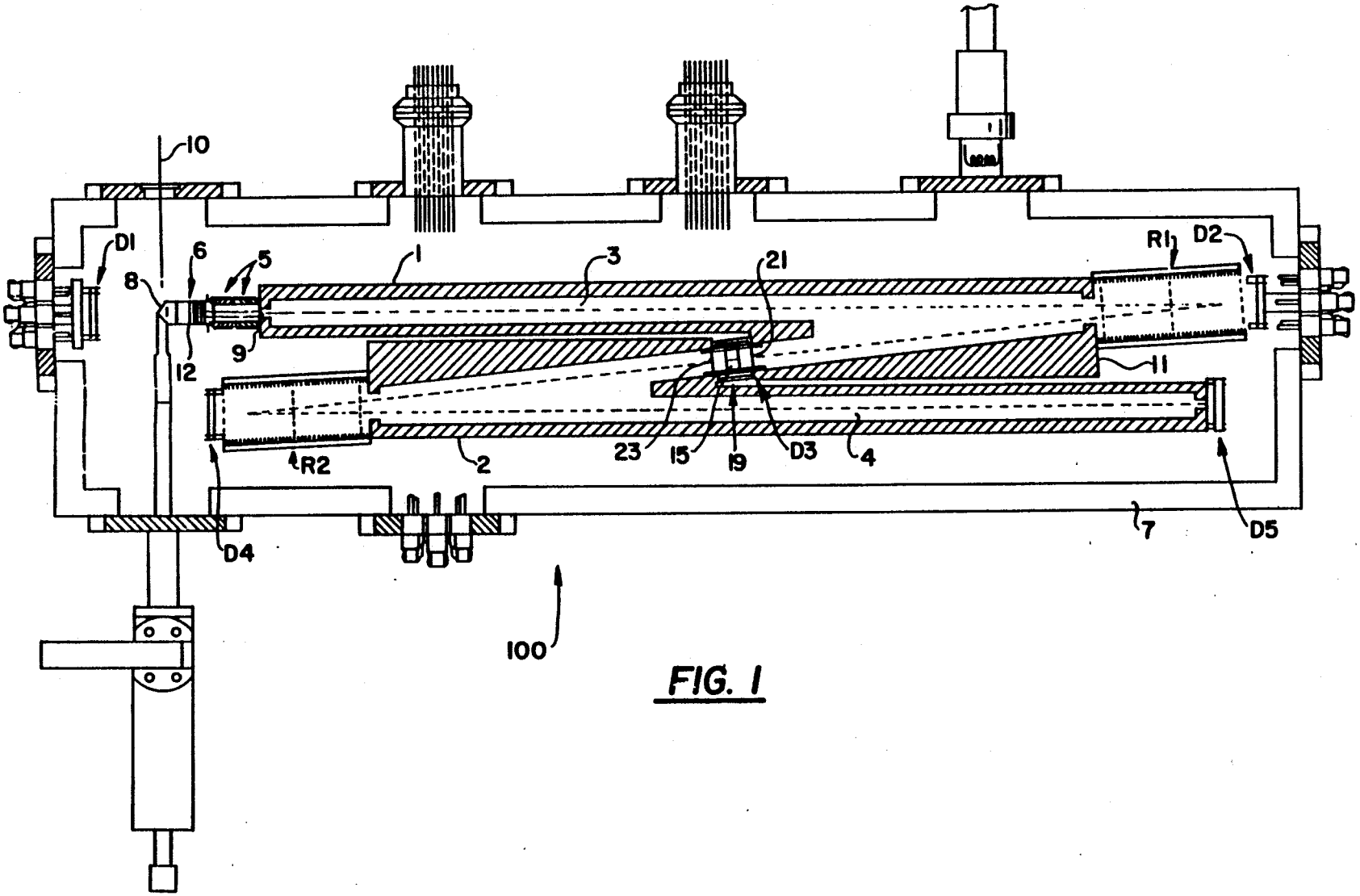
FIG. 1 is a schematic cross-sectional view of the system of the invention.

A series of parallel lens elements 6 in the tandem time-of-flight mass spectrometer 100 define the electrical fields in the ionization, extraction, acceleration and focusing regions. Samples are introduced on a probe tip 8 inserted at right angles to the lens stack, and in-line with a pulsed laser beam 10. In the used extracton mode, the lenses adjacent to the ionization region 12 are at ground potential. Following the laser pulse, these lenses are pulsed to extract negative ions toward the detector D1 and positive ions toward the mass analyzer 1. The height of this pulse provides space focusing, i.e., ions formed toward the rear of the ionization region 12 will receive sufficient additional accelerating energy to enable them to catch up with ions formed at the front of the ionization region 12 as they reach the entrance to the first reflectron R1. A time delay of several microseconds can be introduced between the laser pulse and the extraction pulse to provide metastable focusing. This allows metastable ions to fragment prior to the application of the extraction field. Such ions will then be recorded as fragment ions in the mass spectrum. In the addition, this reduces the possibility that they will fragment during acceleration and reduce the mass resolution.

In the constant field extraction mode, the ionization region 12 may be at high potential or at ground. In either case, the first lens elements on either side of the ionization region are adjusted to provide a constant field across the ionization region for space focusing.

The remaining lens elements accelerate the ions to their final kinetic energies, with the final lens at the voltage of the drift region 3. One or more of these lenses can be adjusted to bring the ions to a focus in the XY-plane at the entrance of the reflectron R1. Two other lenses are split lenses to provide steering in the X and Y directions. The X-lens provides correction for the larger average kinetic energy in the X-direction of ions desorbed from the probe. The voltages on all of these lenses are fixed in both the use and constant field extraction modes.

Provision has also been made for two quadrupole focusing lenses 5. These convert a circular ion beam into a ribbon beam. This permits the beam to be more highly focused in the X-direction, which is the direction of the reflectron angle.

It is generally more convenient to place the drift region 3 at ground potential and the ionization region 12 at high voltage. However, the Bendix MA-2 and CVC-2000 mass spectrometers used grounded ion sources to facilitate the pulsing circuitry, and then enclosed the drift region in a liner floating at high voltage to shield this region from the vacuum housing. Liners are particularly difficult to construct for instruments incorporating a reflectron; therefore, none of the reflectron instruments available commercially use floating drift regions.

In our case, the need for a floatable drift region 3 was dictated by the use of pulsed extraction. In addition, high energy collisions can best be carried out when the product ions are accelerated to a higher kinetic energy than the primary ions. In this case the drift regions 3 and 4 in mass analyzer 1 and 2, respectively, will be at different voltages. The design described below is easy to implement in a square vacuum housing 7, mounted on an optical bench (not shown). In addition, the approach is modular. That is: the design can be used for both MS and MS/MS configurations employing reflectron focusing.

Figure 2:
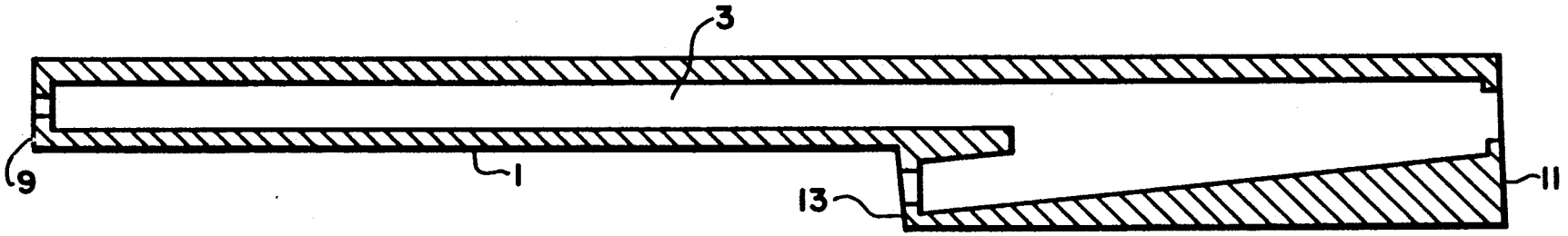
FIG. 2 is a schematic cross-sectional view of a drift chamber.
Figure 3:
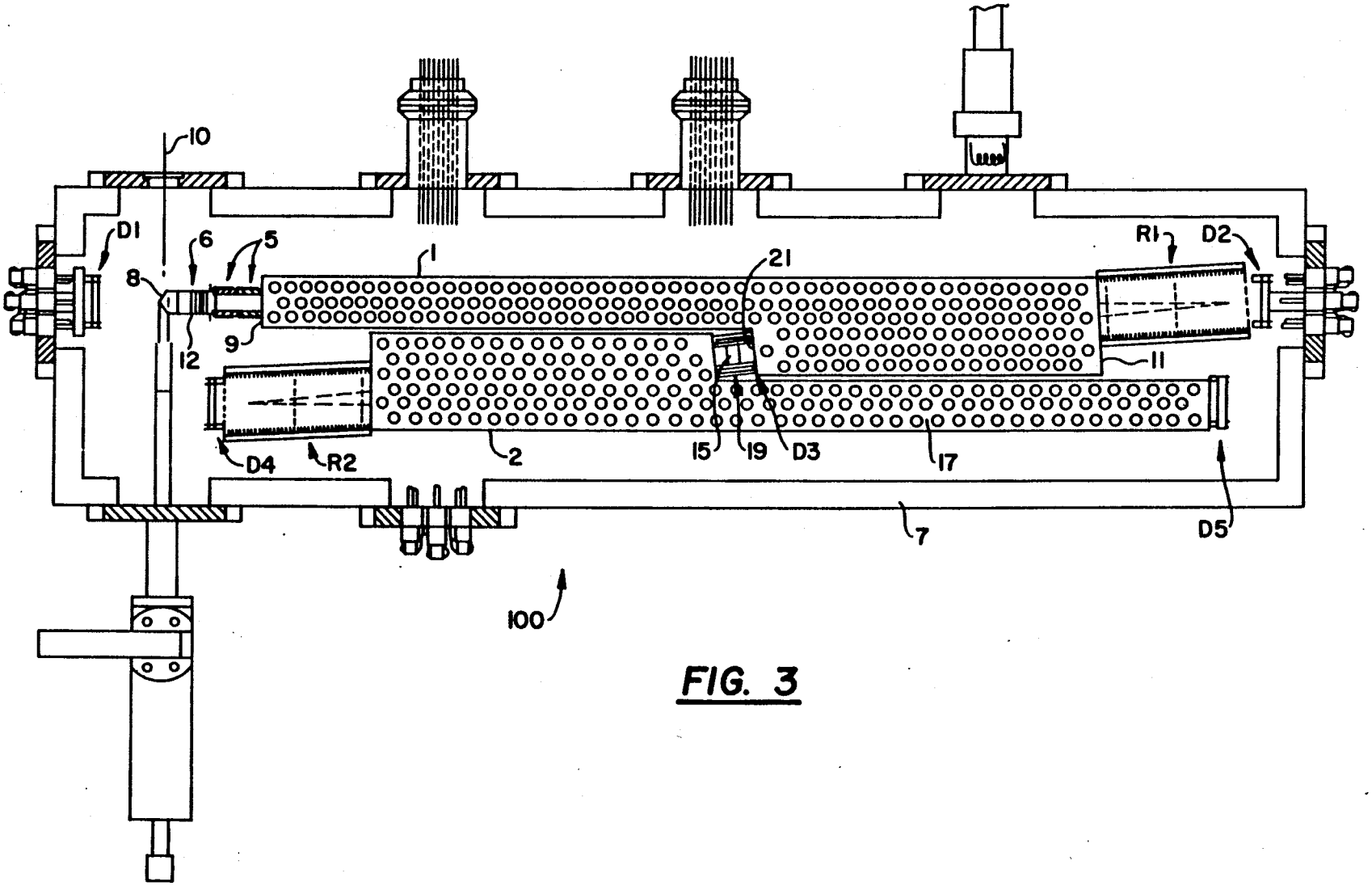
FIG. 3 is a top view of the system of the invention illustrating the stainless steel grids.

The drift chambers 3 and 4 are each constructed from a single bar of 304 stainless steel, which is milled out to provide 1 inch diameter square reflecting channels as shown in FIG. 2. In mass analyzer 1 the ion entrance face 9 serves as a mounting block for all of the ion extraction, acceleration and focusing lenses. The reflectron face 11 is tilted 3° with respect to the ion entrance, and serves as a mounting for the reflectron. The ion exit face 13 is tilted 6° with respect to the ion entrance, as is used to mount the collision chamber 15 (in an MS/MS configuration) or a detector (not shown) (in an MS configuration). In mass analyzer 2, the ion entrance and ion exit are reversed (see FIG. 1). Stainless steel grids 17, as shown in FIG. 3, are attached to the open top and bottom faces to prevent field penetration and to permit good pumping speed.

The reflectrons R1 and R2 are constructed from square lenses with an inner diameter of 1.5 inches. The reflectrons R1 and R2 can be two-stage, with grids attached to the first and fourth lenses, or gridless in which the field is shaped by adjusting the voltages of each lens. The first lens is always at the same potential as the drift chamber. When the instrument is used in a linear mode, i.e., ions are detected without reflection, all of the lenses are at the drift chamber potential. When the instrument is used in the reflectron mode, the potential on the last lens (grid) is adjusted to insure that all ions are reflected.

The collision region 19 consists of a set of deceleration lenses 21, the collision chamber 15 itself, and reacceleration lenses 23. The front and back faces of the collision chamber 15 are electrically isolated from one another to permit pulsed extraction of the product ions in the same manner as in the source. The entire collision region 19 is differentially pumped.

There are a total of five detectors in the instrument, all of which are dual channelplate detectors. The first detector D1 is located behind the ion source (e.g., probe tip 8) and detects the total ion current for ions of opposite polarity to those being mass analyzed. The second detector D2 is located behind the first reflectron R1 and is used to record MS spectra in the linear mode. This detector is also used for initial tuning of the extraction and focusing lenses 5. The third detector D3 is located at the entrance to the collision region. This detector is of the coaxial type, i.e., there is a small diameter hole in the center for passage of the ion beam. This detector records reflectron mode MS spectra when voltages of opposite polarity are placed on a pair of deflection plates at the end of the first drift chamber 3. Ions are selected for passage through this detector to obtain their MS/MS spectra by rapid reversal of the potentials on the deflection plates. A fourth detector D4 is placed behind the second reflectron for initial tuning of the extraction lenses on the collision chamber. The final detector D5 is used to record MS/MS spectra. The output from any of the detectors is fed to a transient recorder (not shown) through a suitable preamplifier for display of the mass spectrum. The spectra are then downloaded to a PC computer (not shown).

While five detectors are included in the current prototype, only two detectors: D3 and D5, are necessary for operation of the instrument. The first detector D3 records and displays the MS spectrum. Ions of a particular mass are selected, and are gated at the appropriate time in each time-of-flight cycle to pass through detector D3 into the collision chamber, and the product ions are recorded and displayed using detector D5.

The ionization region 12, collision chamber 15, the two drift regions 3 and 4, and the two reflectrons R1 and R2 are all electrically isolated and can be varied from +6 kV to −6 kV as appropriate for pulsed or constant field extracton and for high and low energy collisions. While the instrument can be used in a variety of modes, two examples are given to show its versatility.

High energy collisions are, perhaps, the most difficult to carry out on the tandem TF, since the product ions carry considerable (but different) kinetic energies. Thus, for example, a protonated molecular ion beam with an energy spread of 1 eV colliding with helium at 5 keV may produce a fragment ion of about half its mass with an average energy of 2.5 keV. While the reflectron can correct for the small energy spreads, this product ion would only penetrate the first half of the reflectron and would not be well focused. One possibility is to design a dee reflectron, so that ions having fractional kinetic energies will penetrate the linear portion of the reflectron. Alternatively, product ions can be reaccelerated to energies higher than the energy of the primary ion. In this case, the ionization region 12 would be floated at +2 kV, and the first drift region 3 would be at ground potential. The back end of the first reflectron R1 would be slightly above 2 kV, no deceleration would be applied to the ions entering the collision chamber 15 (which would be at ground potential), and collision energies would be 2 keV. Following the collision, all ions would be given an additional 6 keV acceleration, and the second drift region 4 would be at −6 kV. Thus the surviving molecular ions would have final energies of 8 keV entering the reflectron R2, while a half-mass product ion would have an average energy of 7 keV. Both ions would penetrate well into the reflectron and be focused.

Low energy collisions are considerably easier to accomplish. In this case, the ion source could be grounded to permit pulse extracton, and the ions accelerated to the full accelerating voltage of 6 keV, by setting the voltage on the first draft region 3 to −6 kV. The gate pulse passes the ion of interest, which is decelerated to 100 eV by floating the collision chamber 15 at −100 V. The product ions are then reaccelerated to 6 keV by setting the second drift region 4 to the same −6 kV potential as the first, so that the energy range for all product ions entering the second reflectron R2 is now 5,900 to 6,000 eV. If pulsed extraction is not used, one can set the ionization region 12 potential at 6 kV, set the first drift region 3 at ground, the collision chamber 15 at 5,900 V and the second drift region 4 at −6 kV, so that the range of energies entering the second reflectron R2 is 11,900 to 12,000 eV, or about 0.8%. Lower primary energies (floating either the ion source ionization region 12 or drift regions) can also be utilized to improve the time separation between peaks selected for dissociation. Thus, the design is versatile, and can be used for optimizing both resolution and fragmentation efficiency.

The ion optics is mounted in a rectangular aluminum coffin chamber on teflon alignment rails. This vacuum housing 7 is capable of accommodating either the MS or MS/MS configurations. Electrical feedthroughs, pumps, ion gauges, the laser beam entrance window and the sample probe are all mounted on the sides of the vacuum housing 7 via standard ASA flanges.

While the invention has been described in connection with what is presently considered to be the most practical and preferred embodiment, it is to be understood that the invention is not to be limited to the disclosed embodiment, but, on the contrary, is intended to cover various modifications and equivalent arrangement included within the spirit and scope of the appended claims.

What is claimed is:

1. A tandem time-of-flight mass spectrometer comprising:

a grounded vacuum housing; and first and second reflecting-type mass analyzers, disposed in the grounded vacuum housing, being coupled via a collision chamber and comprising first and second flight channels, respectively, said first and second flight channels, said grounded vacuum housing and said collision chamber being electrically isolated to permit electric potential variation in relation to each other.

2. A tandem time-of-flight mass spectrometer as in claim 1, wherein said first reflecting-type mass analyzer and said second reflecting-type mass analyzers each comprise first, second and third end surfaces comprising first, second and third openings, respectively, said collision chamber coupling said third opening of said first reflecting-type mass analyzer to said third opening of said second reflecting-type mass analyzer.

3. A tandem time-of-flight mass spectrometer as in claim 1, wherein:

said first reflecting-type mass analyzer comprises a first detector for detecting a reflectron-mode spectrum of said first reflecting-type mass analyzer, and said second reflecting-type mass analyzer comprises a second detector for detecting a spectra of said tandem time-of-flight mass spectrometer.

4. A tandem time-of-flight mass spectrometer as in claim 2, wherein:

said first reflecting-type mass analyzer comprises a first detector disposed proximate to said third opening of said first reflecting-type mass analyzer, said first detector detecting a reflectron-mode spectrum of said first reflecting-type mass analyzer, and said second reflecting-type mass analyzer comprises a second detector disposed proximate to said first opening of said second reflecting-type mass analyzer, said second detector detecting a spectra of said tandem time-of-flight mass spectrometer.

5. A tandem time-of-flight mass spectrometer as in claim 2, wherein a first reflector is coupled to said second opening of said first reflecting-type mass analyzer and a second reflector is coupled to said second opening of said second reflecting-type mass analyzer.

6. A tandem time-of-flight mass spectrometer as in claim 4, wherein a first reflector is coupled to said second opening of said first reflecting-type mass analyzer and a second reflector is coupled to said second opening of said second reflecting-type mass analyzer.

7. A tandem time-of-flight mass spectrometer as in claim 1, further comprising:

an ionization region for extracting positive charged ions and negative charged ions and providing said positive charged ions to said first reflecting-type mass analyzer; and a detector for detecting the total current of said negative charged ions.

8. A tandem time-of-flight mass spectrometer as in claim 7, wherein each of said first and second flight channels, said grounded vacuum housing and said collision chamber are electrically isolated in relation to said ionization region.

9. A tandem time-of-flight mass spectrometer as in claim 4, further comprising:

an ionization region, proximate to said first opening of said first reflecting-type mass analyzer, for extracting positive charged ions and negative charged ions and providing said first reflecting-type mass analyzer with said positive charged ions; and a third detector, disposed proximate to said first opening of said first reflecting-type mass analyzer, for detecting the total current of said negative charged ions.

10. A tandem time-of-flight mass spectrometer as in claim 6, further comprising:

an ionization region, proximate to said first opening of said first reflecting-type mass analyzer, for extracting positive charged ions and negative charged ions and providing said first reflecting-type mass analyzer with said positive charged ions; and a third detector, disposed proximate to said first opening of said first reflecting-type mass analyzer, for detecting the total current of said negative charged ions.

11. A tandem time-of-flight mass spectrometer as in claim 5, further comprising:

a fourth detector, disposed within said first reflector, for detecting a linear-mode spectrum of said first reflecting-type mass analyzer; and a fifth detector, disposed within said second reflector, for detecting a linear-mode spectrum of said second reflecting-type mass analyzer.

12. A tandem time-of-flight mass spectrometer as in claim 10, further comprising:

a fourth detector, disposed within said first reflector, for detecting a linear-mode spectrum of said first reflecting-type mass analyzer; and a fifth detector, disposed within said second reflector, for detecting a linear-mode spectrum of said second reflecting-type mass analyzer.

13. A tandem time-of-flight mass spectrometer as in claim 2, wherein said first end surface of said first reflecting-type mass analyzer is substantially normal to an initial direction of flight of ions entering said first opening in said first end surface of said first reflecting-type mass analyzer, said third end surface of said first reflecting-typemass analyzer is positioned at a first predetermined angle in relation to said first end surface of said first reflecting-type mass analyzer, said first end surface of said second reflecting-type mass analyzer is substantially normal to a direction of flight of ions approaching said first opening in said first end surface of said second reflecting-type mass analyzer, and said third end surface of said second reflecting-type mass analyzer is positioned at a second predetermined angle in relation to said first end surface of said second reflecting-type mass analyzer.

14. A tandem time-of-flight mess spectrometer as in claim 5, wherein said first end surface of said first reflecting-type mass analyzer is substantially normal to an initial direction of flight of ions entering said first opening in said first end surface of said first reflecting-type mass analyzer, said first end surface of said second reflecting-type mass analyzer is substantially normal to a direction of flight of ions approaching said first opening in said first end surface of said second reflecting-type mass analyzer, said first reflector is positioned at a third predetermined angle in relation to said first end surface of said first reflecting-type mass analyzer and said second reflector is positioned at a fourth predetermined angle in relation to said first end surface of said second reflecting-type mass analyzer.

15. A tandem time-of-flight mass spectrometer as in claim 13, wherein said first predetermined angle and said second predetermined angle are each 6°.

16. A tand:m time-of-flight mass spectrometer as in claim 14, wherein said third predetermined angle and said fourth predetermined angel are each 3°.

17. A method for using a tandem time-of-flight mass spectrometer to determine chemical structures of molecules, comprising the steps of:

grounding a vacuum housing comprising first and second reflecting-type mass analyzers;

coupling said first and said second reflecting-type mass analyzers via a collision chamber;

electrically floating, in relation to said vacuum housing, first and second flight channels of said first and said second reflecting-type mass analyzers, respectively; and detecting-type mass analyzer.

18. A method for using a tandem time-of-flight mass spectrometer to determine chemical structures of molecules as in claim 17, further comprising the step of detecting primary ion mass spectra of said tandem time-of-flight mass spectrometer in a double reflecting mode.

19. A method for using a tandem time-of-flight mass spectrometer to determine chemical structures of molecules as in claim 17, further comprising the step of detecting secondary ion mass spectra of said tandem time-of-flight mass spectrometer.

20. An electrically isolated reflecting flight tube apparatus adaptable for use with a mass spectrometer having an ion producing source and a reflector, comprising:

a flight tube having a channel therethrough, said channel having a rectangular cross section, said ion producing source introducing ions into said channel; and means for electrically isolating said flight tube from said ion producing source and said reflector to permit electric potential variation in relation to each other.

21. An electrically isolated reflecting flight tube apparatus as in claim 20, said flight tube further comprising:

top and bottom outer surfaces, said top and bottom surfaces having first and second longitudinal openings, respectively, extending along a direction of propagation of said ions in said channel; and means for covering said first and second longitudinal openings, said covering means causing pump-out effect while maintaining a field region within said channel of said flight tube.

22. An electrically isolated reflecting flight tube apparatus as in claim 20, wherein a first voltage is applied to said flight tube and a second voltage is applied to said ion producing source, said first voltage and said second voltage being varied independently.

23. An electrically isolated reflecting flight tube apparatus as in claim 20, said channel further having a first section and a second section disposed at an acute angle with respect to said first section, said ions introduced into said channel by said ion producing source propagating through said first section and ions reflected by said reflector propagating through said second section, and said flight tube further comprises first, second and third ends having first, second and third openings therein, respectively, said second opening being rectangular, said first section of said channel coupling said first opening to said second opening and said second section of said channel coupling said second opening to said third opening, said first end coupling said ion producing source to said flight tube at a first predetermined angle and said second end coupling said reflector to said flight tube at a second predetermined angle.

24. An electrically isolated reflecting flight tube apparatus system adaptable for use with a mass spectrometer, comprising:

a flight tube having a channel therethrough, said channel having a rectangular cross section;

an ion producing source, coupled to said flight tube, for introducing ions into said channel of said flight tube;

a reflector, coupled to said flight tube, for reflecting said ions passing through said channel; and means for electrically isolating said flight tube from said ion producing source and said reflector to permit electric potential variation in relation to each other.

25. An electrically isolated reflecting flight tube apparatus system as in claim 24, said flight tube further comprising:

top and bottom outer surfaces, said top and bottom surfaces having first and second longitudinal openings, respectively, extending along a direction of propagation of said ions in said channel; and means for covering said first and second longitudinal openings, said covering means causing pump-out effect while maintaining a field region within said channel of said flight tube.

26. An electrically isolated reflecting flight tube apparatus system as in claim 24, further comprising means for varying a first voltage of said flight tube and a second voltage of said ion producing source independently.

27. An electrically isolated reflecting flight tube apparatus system as in claim 24, said channel further having a first section and a second section disposed at an acute angle with respect to said first section, said ions introduced into said channel by said ion producing source propagate through said first section and ions reflected by said reflector propagate through said second section, and said flight tube further comprises first, second and third ends having first, second and third openings therein, respectively, said second opening being rectangular, said first section of said channel coupling said first opening to said second opening and said second section of said channel coupling said second opening to said third opening, said first end coupling said ion producing source to said flight tube at a first predetermined angle and said second end coupling said reflector to said flight tube at a second predetermined angle.

28. An electrically isolated reflecting flight tube apparatus system as in claim 24, wherein a variable first voltage is applied to said flight tube and said reflector comprises a plurality of rectangular lenses arranged in a row, a second voltage is applied to one of said lenses closest to said flight tube, said second voltage being equal to said first voltage applied to said flight tube.

29. An electrically isolated reflecting flight tube apparatus adaptable for use with a mass spectrometer having an ion producing source and a reflector, comprising:

a flight tube having a channel therethrough, said channel having a rectangular cross section into which said ions from said ion producing source are introduced, said channel further having a first section and a second section disposed at an acute angle with respect to said first section, said ions introduced into said channel by said ion producing source propagating through said first section and ions reflected by said reflector propagating through said second section;

said flight tube further comprises first, second and third ends having first, second and third openings therein, respectively, said second opening being rectangular, said first section of said channel coupling said first opening to said second opening and said second section of said channel coupling said second opening to said third opening, said first end coupling said ion producing source to said flight tube at a first predetermined angle and said second end coupling said reflector to said flight tube at a second predetermined angle; and, means for electrically isolating said flight tube from said ion producing source and said reflector to permit electric potential variation in relation to each other.

30. An electrically isolated reflecting flight tube apparatus as in any of claim 20–29, wherein said rectangular cross section is substantially square.

31. An electrically isolated reflecting flight tube apparatus as in claims 21 and 25, wherein said covering means is a wire mesh.

32. An electrically isolated reflecting flight tube apparatus as in claims 20 or 29, wherein two of said isolatable reflecting tube apparatus are utilized as tandem reflecting flight tubes in a tandem mass spectrometer.

33. An electrically isolated reflecting flight tube apparatus as in claim 24, wherein two or said flight tubes are utilized as tandem reflecting flight tubes in a tandem mass spectrometer.

* * * * *